United States Patent [19]

Schwarzli

[11] Patent Number: 4,534,492

[45] Date of Patent: Aug. 13, 1985

[54] COIN OPERATED VENDING MACHINE HAVING A SECURE CASHBOX AND AN ANTITAMPERING SAFETY MECHANISM

[76] Inventor: Joseph W. Schwarzli, Vandorf Rd., R.R. #4, Stouffville, Ontario, Canada L0H 1L0

[21] Appl. No.: 576,251

[22] Filed: Jan. 30, 1984

[51] Int. Cl.[3] ..... G07F 11/44

[52] U.S. Cl. ..... 221/203; 221/248

[58] Field of Search ..... 221/155, 265, 282, 283, 221/285, 248, 203

[56] References Cited

U.S. PATENT DOCUMENTS

| | | | |
|---|---|---|---|
| 1,785,107 | 12/1930 | Bartholomew | 221/283 X |
| 2,664,227 | 12/1953 | Probasco | 221/265 X |
| 2,990,975 | 7/1961 | Sereno | 221/265 X |
| 3,028,049 | 4/1962 | Eppy | 221/265 X |

*Primary Examiner*—Stanley H. Tollberg
*Attorney, Agent, or Firm*—Ridout & Maybee

[57] ABSTRACT

A coin operated vending machine comprises a housing having upright walls, a base, a top, and a partition between the base and top dividing the housing into an upper product bin and a lower cashbox. The partition defines an aperture therethrough to provide communication between the bin and cashbox and has a spindle protruding upwardly from the central portion thereof. A dispensing wheel is provided having a hub with bearing means at the center thereof for engaging the spindle and supporting the wheel upon rotation thereof about the spindle, and having a rim with a plurality of gear teeth about the circumference of the bottom edge thereof. A coin activated gear mechanism is positioned in an upright wall of the housing in the vicinity of the partition, said mechanism having a handle attached to one end of a shaft and a transmission gear attached to the other end thereof. Structure is provided for locking a delivery chute in place thereby restricting access to the cashbox. Structure is positioned above the dispensing wheel at that portion of the partition defining the aperture therethrough for excluding all loose items of product from the aperture in the partition, thereby insuring that only items in containers are dispensed upon opertion of the machine. The door for the delivery chute activates a safety mechanism which locks the transmission gear upon opening the door.

29 Claims, 17 Drawing Figures

FIG. 3
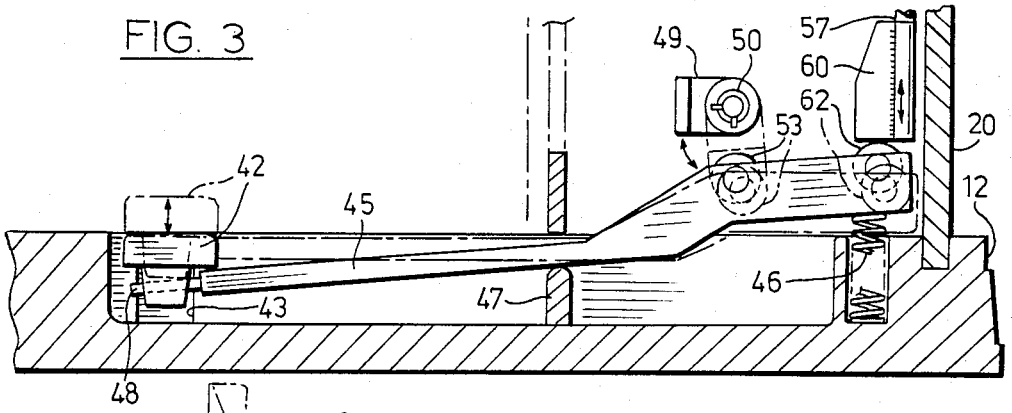
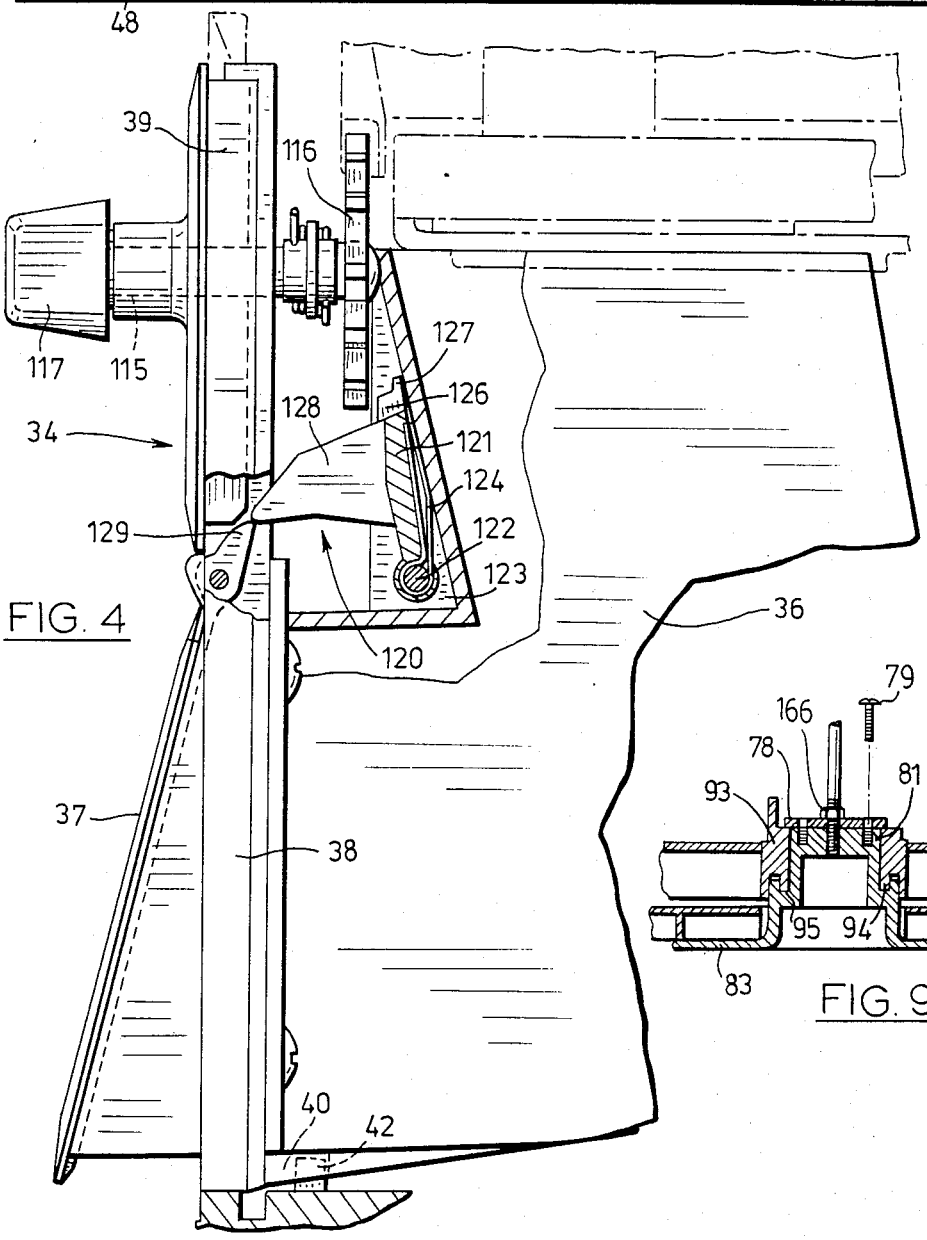
FIG. 4
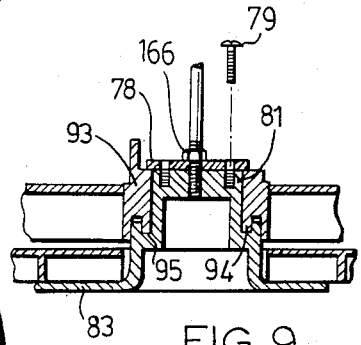
FIG. 9

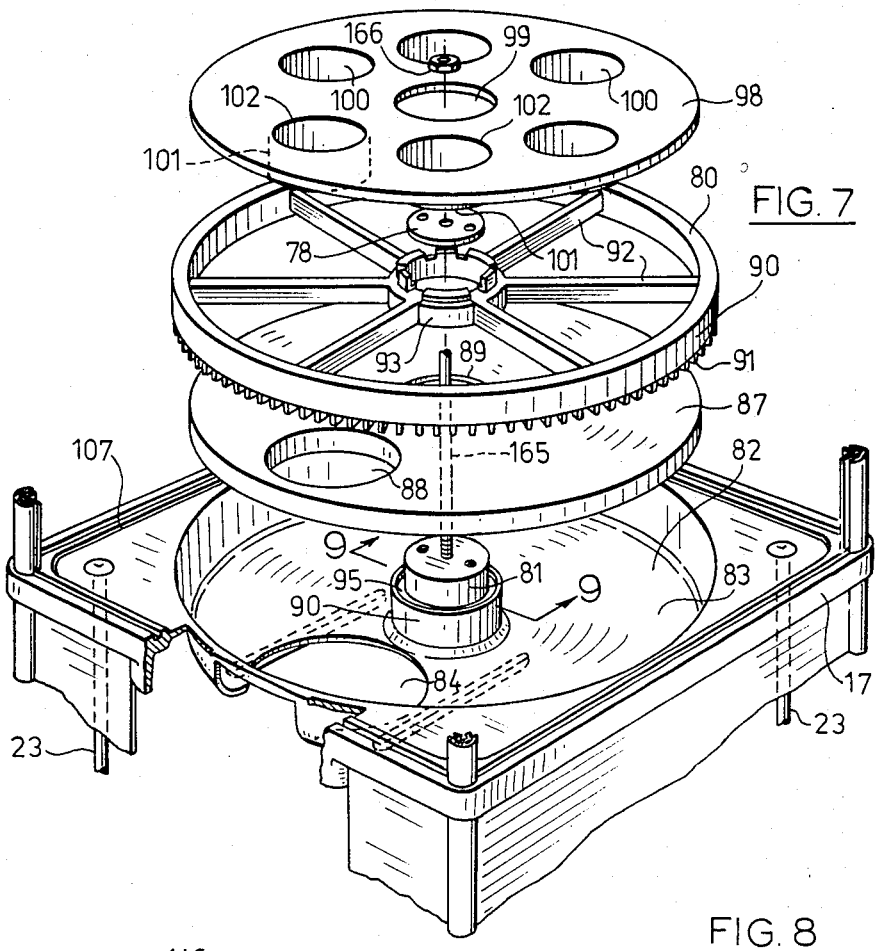
FIG. 7
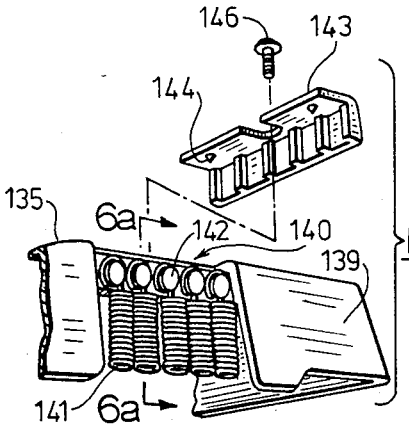
FIG. 6
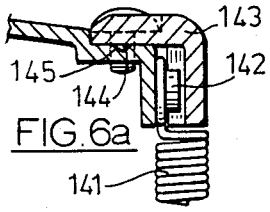
FIG. 6a
FIG. 8
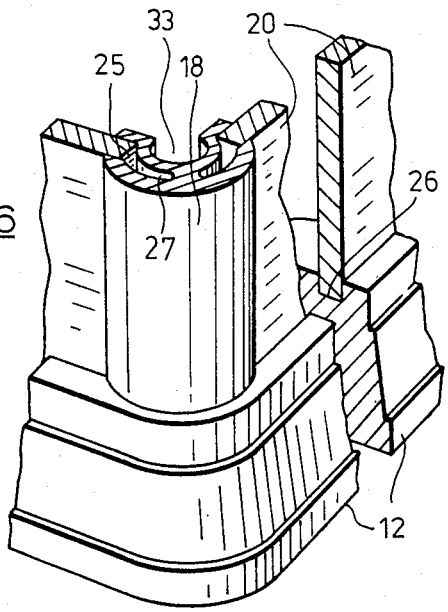

FIG. 12
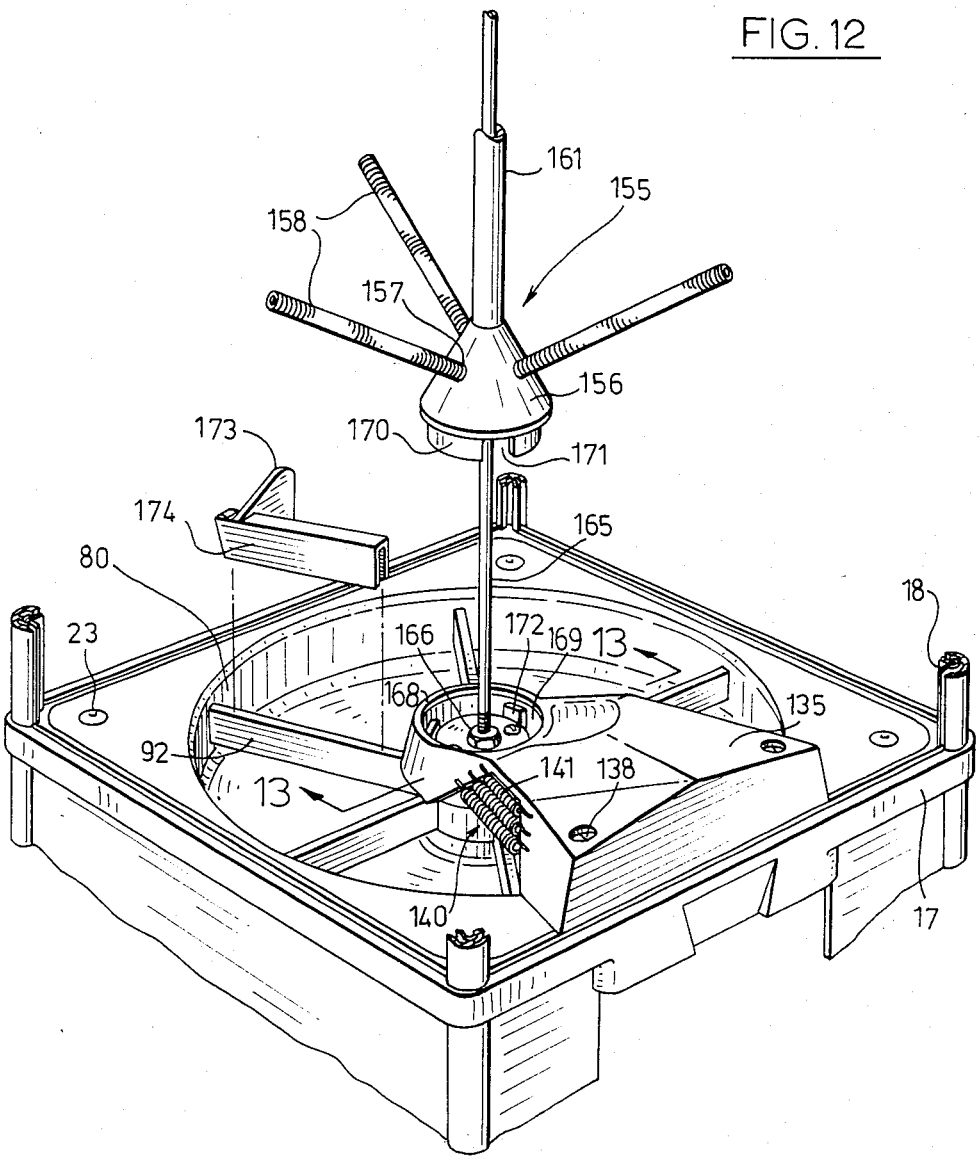
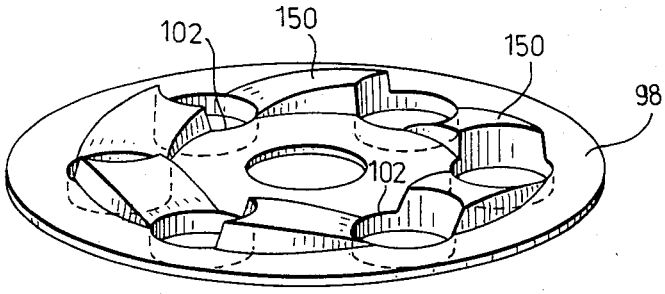
FIG. 14

COIN OPERATED VENDING MACHINE HAVING A SECURE CASHBOX AND AN ANTITAMPERING SAFETY MECHANISM

The invention relates to a coin operated vending machine which may be adapted to vend products within a significantly broader range of sizes than has heretofore been realized. The invention also provides a new safety mechanism associated with the product delivery chute and a cashbox which is accessible independently of the product bin portion of the machine.

The present device preferably incorporates a number of improvements designed to overcome well recognized shortcomings in prior machines of the same kind. Cashbox security is a primary concern for any vending machine owner. While there are many known ways to provide adequate security for a vending machine, it is desirable to incorporate security features into the machine which may be easily manufactured and serviced thereby minimizing the cost. The present machine provides a new locking configuration for securing the cashbox from unwanted access by locking the product delivery chute within the only access opening into the cashbox portion of the machine.

With the advent of the tremendous variety of novelty items which may be offered for sale in vending machines, it is desirable to provide means for enabling the distribution of such items from a single machine. Prior machines are not flexible in this regard and are only suitable for vending items of a specific narrow size range. Adapting prior machines to dispense items of a size other than that for which they were specifically intended is costly or simply not practical.

The vending mechanism of the present machine is adaptable to accommodate products having a wide range of sizes by virtue of the use of easily interchangeable components associated with the dispensing wheel. Improved means are provided for excluding all but one product from the delivery chute upon activation of the device, and improved means are provided for eliminating bridging of product items within the product bin thereby insuring uninterrupted dispensing of product items by the dispensing wheel.

Vending machines of the present type are often used to sell gum balls or novelty items encapsulated in rounded plastic containers. Such products are mainly purchased by children, and as a result, it has been found to be very desirable to make this type of machine as child-proof as possible. Experience has shown that children frequently probe with their hands as far as possible up the delivery chute. With the introduction of large machines dispensing relatively large items, it has become easier for a child to reach through the chute into the dispensing wheel mechanism of the machine. While this probing does not usually result in successfully dislodging an item of product, it can lead to a jamming of the dispensing mechanism with a concurrent trapping of the hand or fingers of the child therein.

To prevent a child from tampering with the dispensing mechanism by probing through the delivery chute which may result in injury, a safety feature is provided whereby opening of the door covering the exit of the delivery chute causes a locking device to engage the transmission gear of the coin activated gear mechanism thereby preventing further rotation of the dispensing wheel. Closure of the chute door causes disengagement of the locking device.

Accordingly, the invention provides a coin operated vending machine comprising a housing having upright walls, a base, a top, and a partition between the base and top dividing the housing into an upper product bin and a lower cashbox. The partition defines an aperture therethrough to provide communication between the bin and cashbox and has a spindle protruding upwardly from the central portion thereof.

A dispensing wheel is provided having a hub with bearing means at the center thereof for engaging the spindle and supporting the wheel upon rotation thereof about the spindle, and having a rim with a plurality of gear teeth about the circumference of the bottom edge thereof. Retaining members are provided between the hub and the rim defining a plurality of product openings in the wheel which are uniformly spaced from one another and the center of the wheel and are registrable with the aperture in the partition upon rotation of the wheel. The retaining members in combination with the surface of the partition form containers for items of product to be dispensed.

A coin activated gear mechanism is positioned in an upright wall of the housing in the vicinity of the partition, said mechanism having a handle attached to one end of a shaft and a transmission gear attached to the other end thereof. The transmission gear engages the teeth about the rim of the dispensing wheel so that rotation of the gear causes rotation of the wheel. A product delivery chute is positioned within the cashbox, one end of which abuts the partition about the periphery of the aperture therethrough and the other end of which protrudes through an opening in an upright wall of the housing. Means are provided for locking the delivery chute in place thereby restricting access to the cashbox. Means are positioned above the dispensing wheel at that portion of the partition defining the aperture therethrough for excluding all loose items of product from the aperture in the partition, thereby insuring that only items in containers are dispensed upon operation of the machine.

A description of a preferred embodiment of the invention follows with reference to the drawings in which.

Figures 2, 2A:
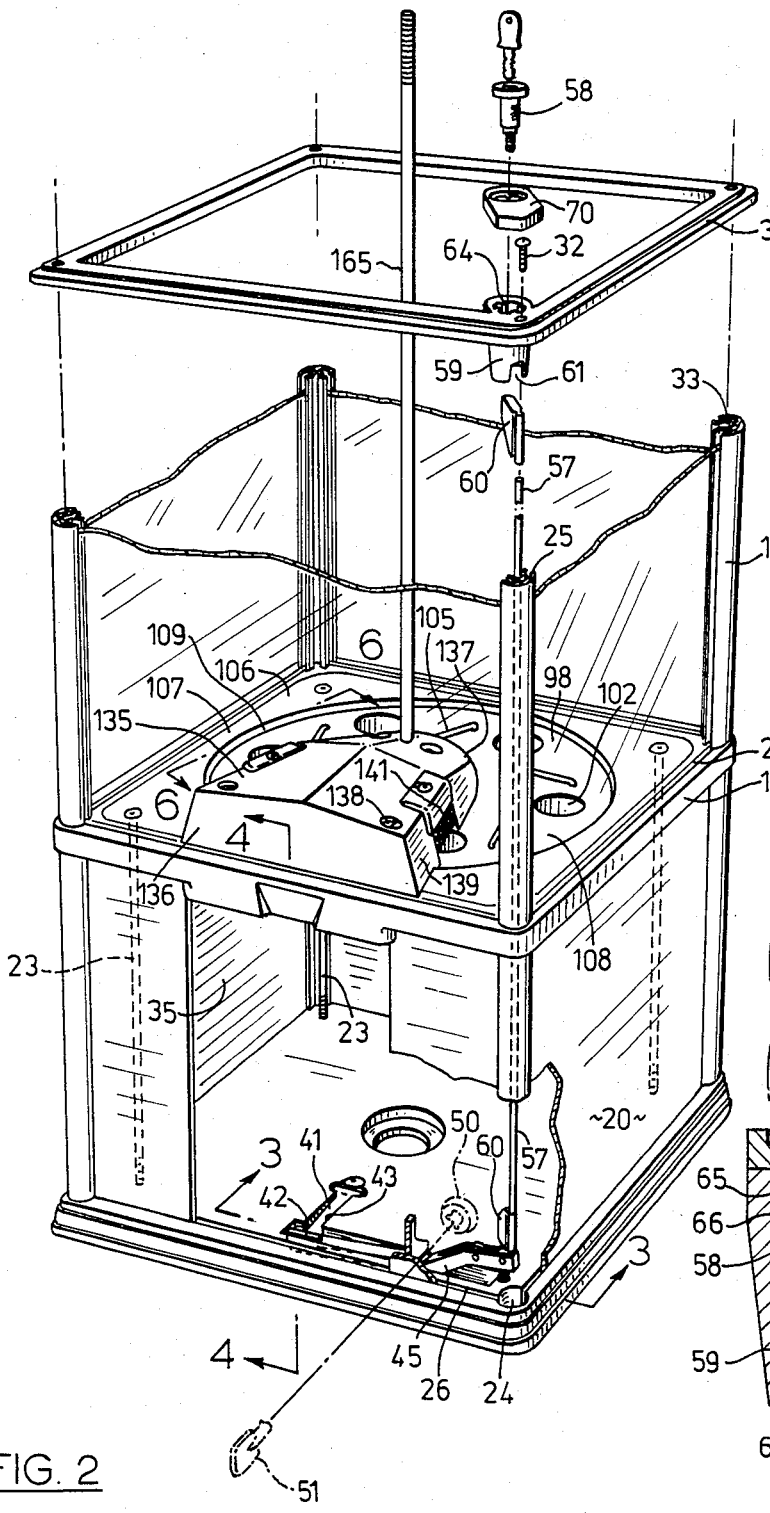
FIG. 2 is a partially broken away and partially exploded view of the machine of FIG. 1 showing details of the cashbox locking mechanism.
Figure 5:
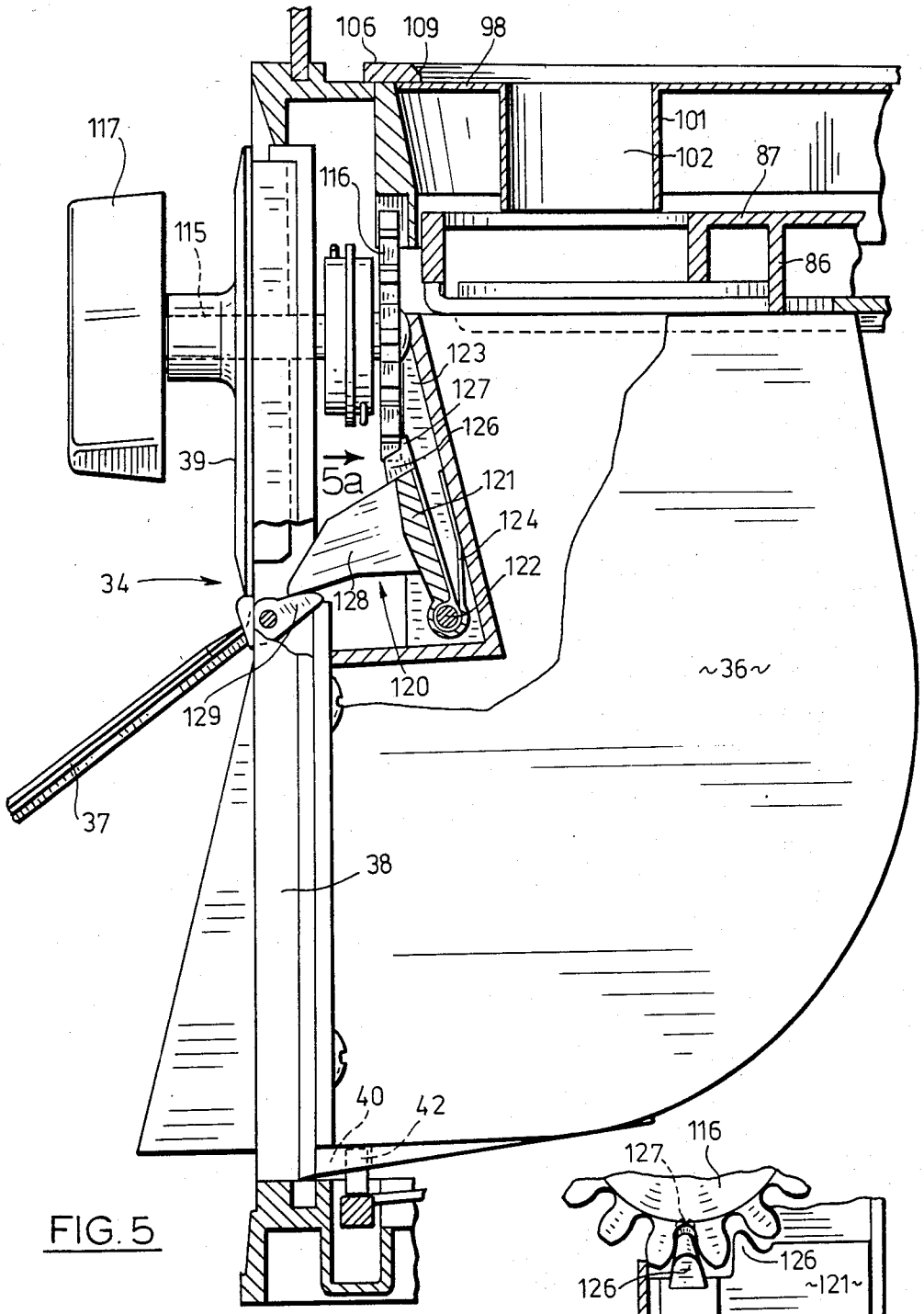
Figure 5A:
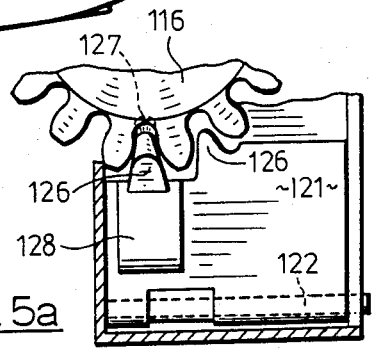
Figure 10:
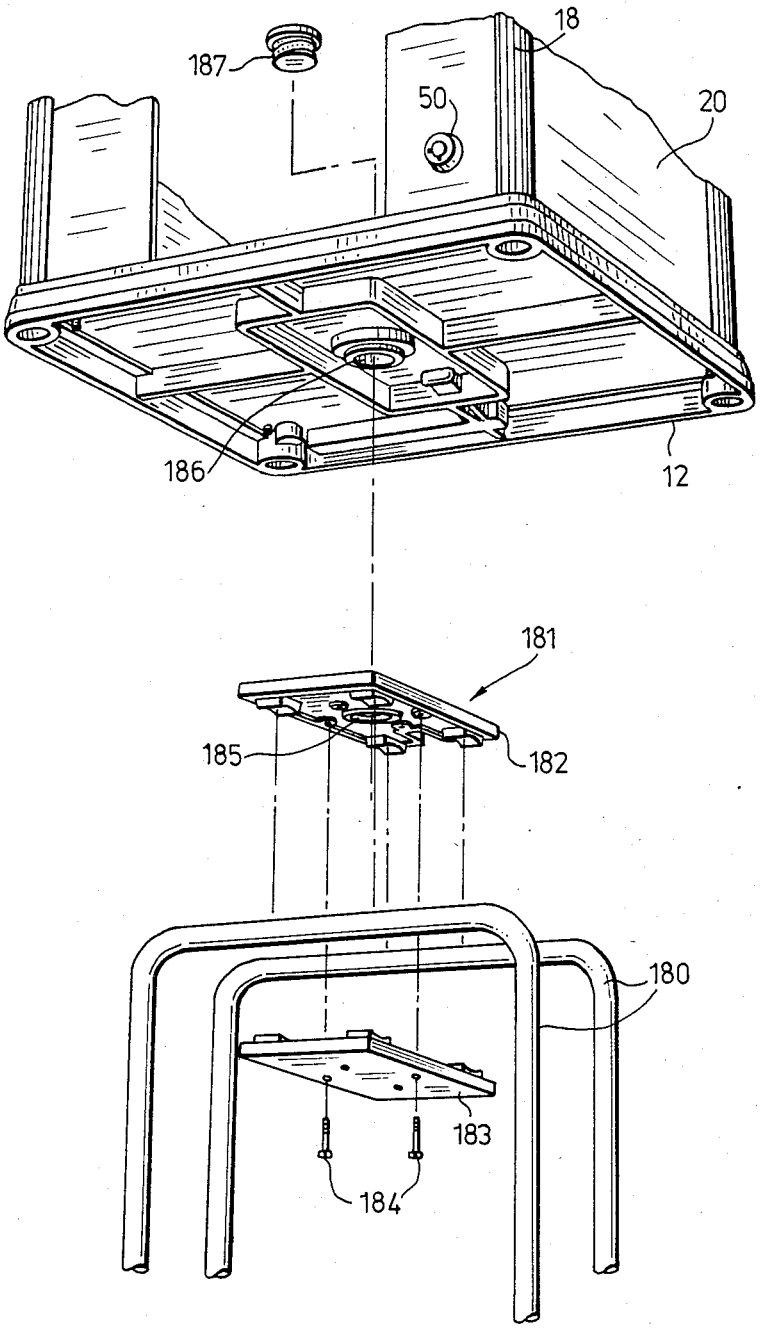
Figure 11:
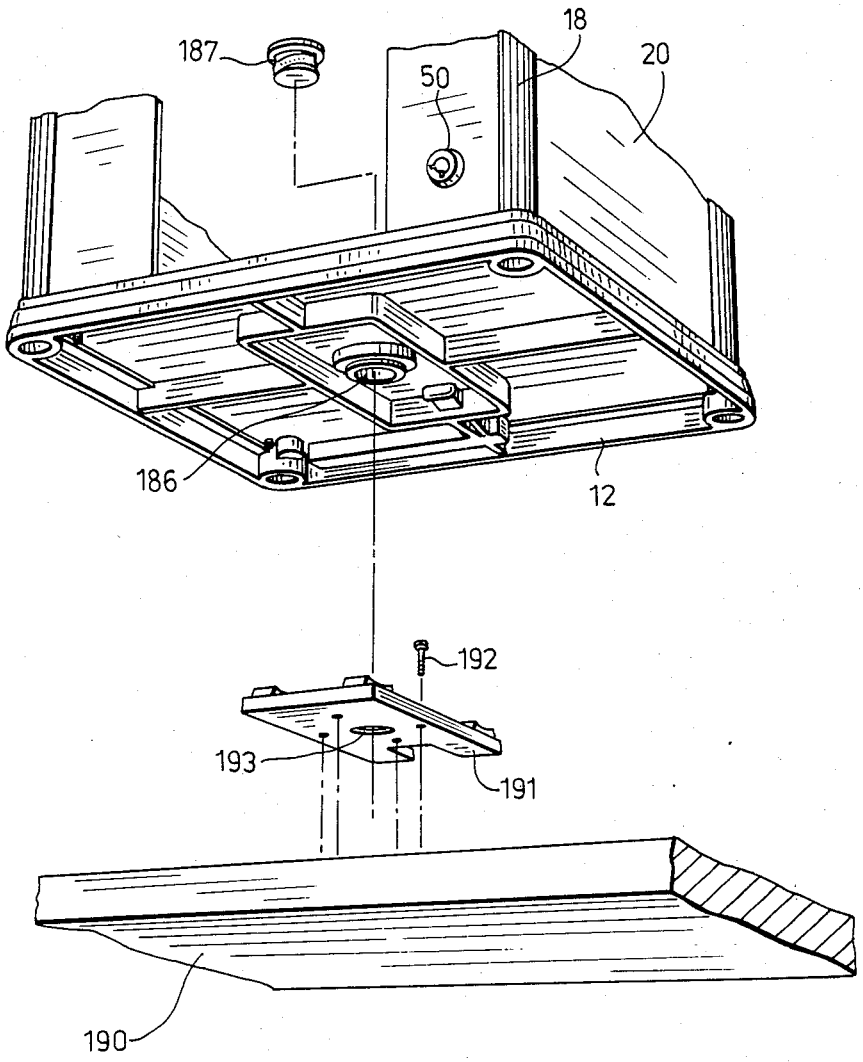
Figure 13:
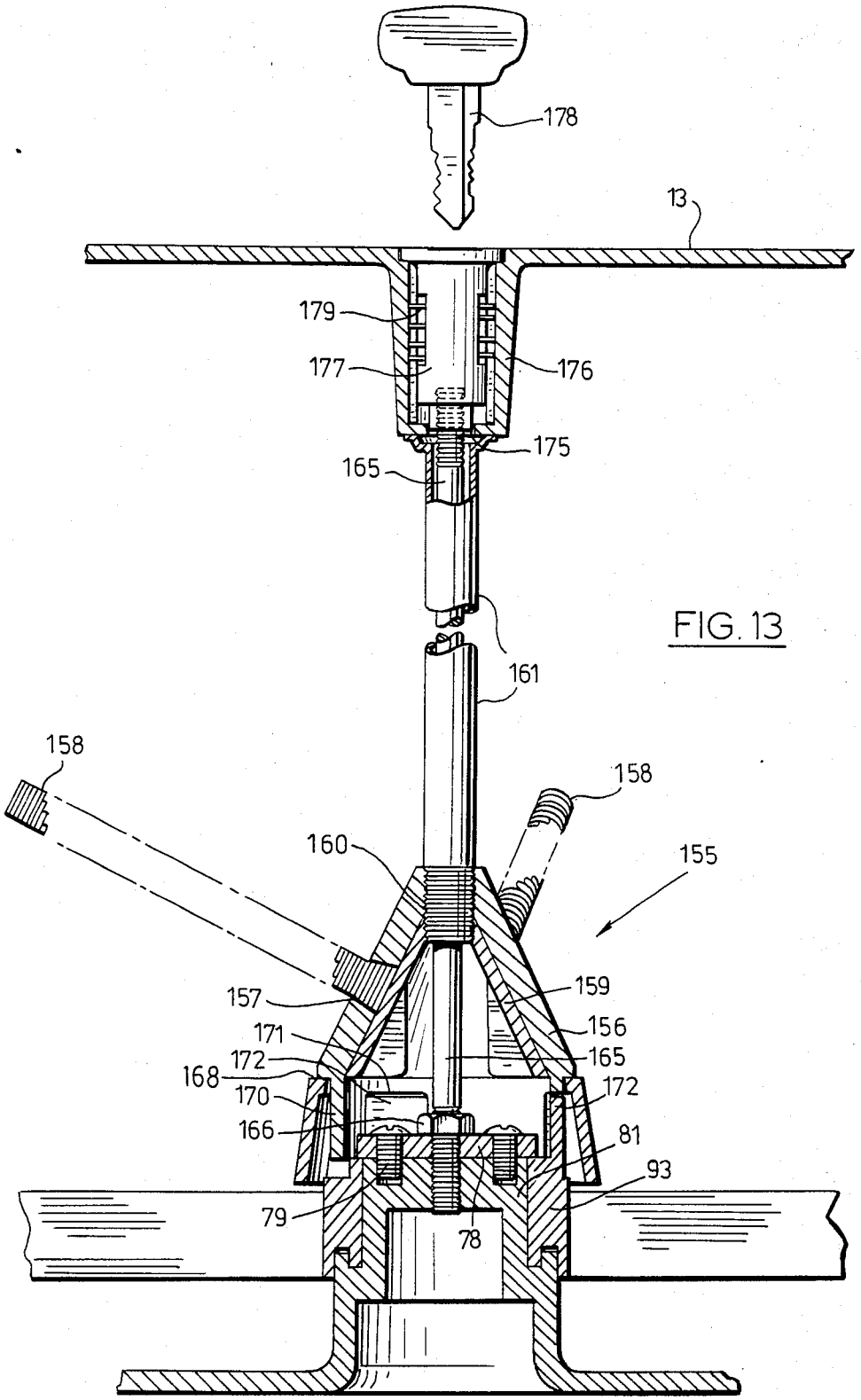

FIG. 2*a* is a detail of the locking mechanism shown in FIG. 2;

FIG. 3 is a further detail of the locking mechanism shown in FIG. 2;

FIG. 4 is a side elevation partially broken away showing details of a preferred safety feature in the disengaged mode;

FIGS. 5 and 5*a* show details of the feature shown in FIG. 4 when in the engaged mode;

FIGS. 6 and 6*a* show details in perspective and cross section of means for excluding all but the selected product item from the delivery chute;

FIG. 7 is an exploded view of a preferred dispensing wheel assembly;

FIG. 8 is a sectional perspective view showing a detail of construction of the housing of the preferred machine;

FIG. 9, which is shown on the same sheet as FIGS. 3 and 4, is a cross sectional view of the spindle and the detail thereabout of the dispensing wheel assembly;

FIG. 10 is an exploded view of a bracket assembly for attaching the machine to a rack;

FIG. 11 is an exploded view of a bracket assembly for securing the base of the machine to a flat surface;

FIG. 12 is a perspective view partially exploded and broken away showing a preferred distribution device for preventing product bridging, and showing an alternative arrangement of the dispensing wheel assembly for use with large items;

FIG. 13 is a cross sectional view of the distribution device of FIG. 12 as assembled on the spindle and showing in section the locking mechanism for the cover of the machine; and FIG. 14, which is shown on the same sheet as FIG. 12, is a perspective view of a modified dispensing wheel upper plate for the dispensing wheel having agitation means integral therewith.

Figure 1:
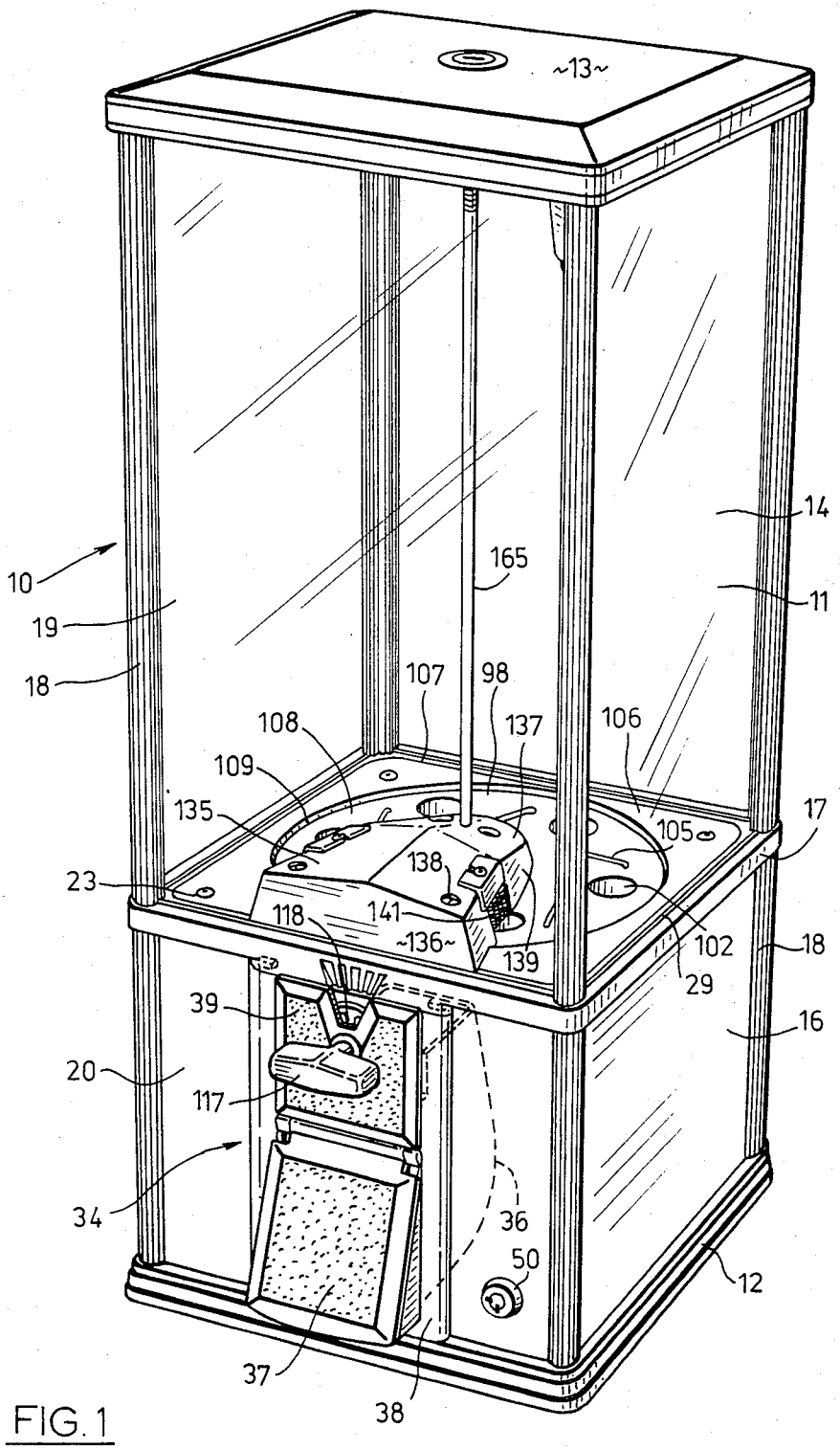
FIG. 1 is a perspective view of the assembled machine.

The preferred embodiment shown in FIG. 1 comprises a housing 10 having upright walls 11, a base 12 and a top 13. The housing 10 is divided into an upper bin 14 and a lower cashbox 16 by a partition 17. Vertical structural members 18 extend through the partition 17 from the base 12 to the top 13. The partition 17 divides the upright walls 11 into upper wall portions 19 and lower wall portions 20. The upper wall portions 19 are preferably longer than the lower wall portions 20, and the upper wall portions 19 together with the associated structural members 18, the top 13 and the partition 17 define the bin 14 for the purpose of containing items of the product (not shown) to be dispensed. The lower wall portions 20 together with the associated structural members 18, the base 12 and the partition 17 define the cashbox 16 for receiving coins inserted into the machine during operation thereof.

Preferably, the top 13, base 12, structural members 18 and lower wall portions 20 are made of a strong, rigid and opaque material such as metal. In particular, it has been found that aluminum is a suitable material for use in most structural elements of the machine since it possesses the properties of high strength and light weight while being resistant to corrosion. In contrast, the upper wall portions 19 are preferably transparent but non-breakable and therefore, may suitably be made of acrylic or polycarbonate plastic.

As shown in FIGS. 2 and 8, structural members 18 are fastened at the corners of the base 12 in receptacles 24 and lower wall portions 20 are secured in place by means of slots 25 in structural members 18 and slots 26 in the base 12. The members 18 are preferably semicircular in cross section and the slots 25 formed therein have a curved portion 27 which provide a slight degree of resiliency to allow for the slight variability inherent in the thickness of plastics used for the wall portions 19. The partition 17 is provided with openings at each corner thereof to allow extension of the structural members 18 therethrough, and the partition 17 is secured in place by bolts 23 extending from the four corners of the partition 17 to the base 12. The bolts 23 serve to provide additional security for the cashbox 16. The partition 17 has slots 29 near the perimeter in both the upper and lower face thereof to accommodate the edges of the upper and lower wall portions 19 and 20. The top edge of each upper wall portion 19 and the top end of each structural member 18 are secured by a frame 31 provided with a peripheral slot and corner receptacles (not shown) in the underside thereof for the purpose. The frame 31 is fastened in place preferably by screws 32 which tap into the central channel 33 of the structural members 18.

One of the lower wall portions 20 is provided with an aperture 35 into which is fitted an assembly 34 comprising a product delivery chute 36 having an outer door 37. The chute 36 is attached to a U-shaped frame 38 near the exit end thereof. The frame 38 serves as a support structure for a coin operated gear mechanism 39, and the frame 38 is flanged to provide overlap with adjacent wall portions 20. While the coin operated gear mechanism 39 may be located elsewhere in the machine, it is convenient and preferable for manufacturing and security reasons to situate the mechanism 39 in this manner.

The aperture 35 provides the only intended means for accessing the interior of the cashbox 16, thus means are provided for locking the assembly 34 in place. As shown in FIGS. 2–5, a notch 40 is provided in the bottom of the chute 36 at the area of abutment with the bottom of the frame 38. A pivotable arm 41 having a flanged end 42 is provided in a slot 43 in the base 12. A lever 45 biased by a spring 46 about a fulcrum 47 is provided with a pin 48 which passes through a hole near the end of the arm 41. To raise and lower the flanged end 42 into or out of the notch 40, the lever 45 may be activated by one of two alternative key activated means. As shown in FIGS. 2 and 3 the wall portion 20 in front of the lever 45 may be equipped with a cam 49 associated with a key activated lock mechanism 50. Insertion of a key 51 into the lock 50 allows for rotation of the cam 49 in the desired manner in relation to the lever 45 to either secure or release the assembly 34. To provide a smooth interaction of the cam 49 against the spring biased lever 45, the lever 45 is provided with a roller 53 at the area of engagement with the cam 49.

The lever 45 may also be activated by a rod 57 running along the channel 33 in the adjacent structural member 18. Vertical movement of the rod 57 against the lever 45 is governed by a screw lock 58 operable in threaded receiving member 59 affixed to a corner of the frame 31 as shown in FIGS. 2 and 2*a*. Both ends of the rod 57 are provided with a flange 60, the upper flange 60 fitting into a slot 61 in the member 59 to insure contact with the screw 58 and the lower flange 60 being in contact with the lever 45 at a roller 62 provided therein to assist the action of the rod 57 against the lever 45. The screw lock 58 is of conventional design having locking pins 65 which engage the inner wall 66 of the member 59 between vertical ribs or splines 64 to prevent rotation of the screw lock 58. Insertion of a key 67 into the lock 58 causes retraction of the pins 65 thereby enabling free rotation of the screw lock 58. To provide security to cashbox 16 access by way of disassembly of the frame 31, a cover plate 70 is provided over the screw 32 fastening the frame 31 to the structural member 18, which cover plate 70 is also secured by the screw lock 58.

FIG. 7 shows the means for dispensing product items from the bin 14 through the delivery chute 36 upon activation of the coin operated gear mechanism 39. A toothed wheel 80 rotates about a spindle 81 located in the centre of a circular depression 82 formed in the partition 17. The wheel 80 is secured in place on the spindle 81 by a washer 78 and screws 79. A circular portion 83 of the partition 17 defining the bottom of the depression 82 is provided with an aperture 84 directly above the top end of the chute 36, which top end abuts the circular partition surface 83. The aperture 84 is of a size commensurate with but not exceeding the size of the opening defined by the upper end of the chute 36. Thus, the aperture 84 defines the size of the largest product item which may be dispensed from the bin 14.

The size of the aperture 84 may be reduced to accommodate the dispensing of smaller items by means of a circular plate 87 having a diameter less than the inside diameter of the wheel 80, and which is provided with a circular opening 88 reduced in size from the aperture 84. The plate 87 has a center hole 89 which fits over the base portion 90 of the spindle 81, and the plate is held in place with the opening 88 situated over the aperture 84 by means of a flange 86 (FIG. 5) at the underside of the plate 87 about the opening 88 which fits closely within the aperture 84.

The wheel 80 has a rim 90 with gear teeth 91 about the circumference of the bottom edge thereof. Spokes 92 radiate from a hub 93 to the rim 90. The underside of the hub 93 is provided with a circular bearing surface 94 (FIG. 9) which fits into a groove 95 in the spindle 81, the surfaces of the bearing 94 and groove 95 engaging one another. The groove 95 is provided with lubricating grease for the rotation of the wheel 80 and serves to contain the grease therein thus preventing the travel of grease away from the contacting surfaces. Attachable to the top of the wheel 80 is a circular plate 98 having a central hole 99 of a diameter just greater than the outside diameter of the hub 93 and having a plurality of product openings 100 registrable with the apertures 84 and 88 upon rotation of the wheel 80. The product openings 100 are of a size commensurate with that of the items being dispensed so that a single item may drop readily into each opening 100. Cylindrical retaining members 101 are affixed about the openings 100 or formed integrally therewith at the underside of the plate 98. The retaining members 101 are of a height sufficient to leave a small space between the bottom thereof and the surface of the plate 87. Thus, the combination of retaining members 101 and the plate surface 87 provides a series of containers 102 for items to be delivered to the apertures 84 and 88 for dispensing down the chute 36.

From the foregoing it should be appreciated that the combination of wheel 80 with the plates 87 and 98 provides a great deal of flexibility with respect to the size of product item which may be offered for sale in the vending machine. Thus, while the arrangement of components shown in FIG. 7 is suitable for a range of relatively small items such as gum balls, larger items such as novelties encapsulated in rounded plastic containers, may be dispensed simply by using the wheel 80 as shown in FIG. 12 without the circular plates 87 or 98. In this latter configuration, the spokes 92 combine with the circular surface 83 to define the containers 102.

In the preferred embodiment illustrated in FIGS. 1 and 2, guide means 105, which may be ribs, are provided in and may be formed integrally with the plate 98 to assist in the deposition of product items into the containers 102. A cover plate 106 fits over the partition 17 within its interior perimeter 107. The cover plate 106 has a central circular opening 108 of a diameter slightly less than that of the wheel 80 thereby slightly overlapping the wheel 80 but not interfering with its rotation. The cover plate 106 thus causes the wheel 80 to be recessed from the upper plane of the partition assembly defined by the plate 106, and a circular curb 109 thus created at the circumference of the opening 108 provides a surface in conjunction with which the guide means 105 may operate to encourage the positioning of product items for deposition into the containers 102. The curb 109 also prevents small bits of debris from broken product items from entering the transmission assembly and possibly jamming the machine.

The wheel 80 is rotated by the coin operated gear mechanism 39 which is commercially available. The mechanism 39 (FIGS. 4 and 5) comprises a shaft 115 to one end of which is attached a transmission gear 116 and to the other end of which is attached a handle 117. The mechanism 39 is positioned in the frame 38 so that the gear 116 engages the teeth 91 of the wheel 80. Insertion of the proper coinage in the slot 118 of the mechanism 39 enables rotation of the handle 117 and hence the wheel 80. Clearly, there is a wide degree of choice available with respect to the gear ratios between the transmission gear 116 and the teeth 91 of the wheel 80 so that the proper degree of rotation of the wheel 80 can be obtained to successively center the variously sized containers 102 over the apertures 84 and 88.

The invention provides a safety mechanism 120 associated with the door 37 of the chute 36 and which is shown in FIGS. 4 and 5. The mechanism 120 is designed to lock the transmission gear 116, and hence prevent rotation of the wheel 80 when the door 37 is open. The mechanism 120 comprises a plate 121 pivotally mounted along its lower edge on a rod 122 in a recess 123 provided in the upper front portion of the chute 36. The plate 121 is biased to pivot forwardly by a spring 124. The plate 121 has teeth 126 at its upper edge in the region directly adjacent the lower portion of the transmission gear 116 so that when the plate is in its forwardly biased position, the teeth 126 engage the gear 116 preventing further rotation thereof. As seen from FIGS. 5 and **5*a* a metal web 127 is maintained between the teeth 126 so that contact with the gear 116 is insured. The plate 121 is also provided with an arm 128 which coacts with a cam 129 mounted on the top edge of the door 37. When the door 37 is closed, as in FIG. 4, the cam 129 acts on the arm 128 to force the plate 121 to the retracted position. However, opening the door, as in FIG. 5, causes the cam 129 to slip under the arm 128 thereby allowing the plate 121 to move forward to engage the gear 116**.

The invention provides means for excluding all but the single item of product in the container 102 from which such item is dispensed upon operation of the machine. This exclusion means is shown in two alternative embodiments, the first of which is illustrated in FIGS. 1, 2 and 6. As seen in these figures, the exclusion means comprises a shell 135 having a flat rear surface 136 abutting the upper wall portion 19, and a curved front portion 137 which fits over and is secured to the spindle 81 by screws 79 also used to secure the washer 78 in place. The shell 135 may also be secured to the partition 17 by means of fasteners running through holes 138 in the top of the shell 135 adjacent the rear surface 136. The height of the shell 135 above the plate 98 is sufficient to provide clearance for a product item seated in a container 102. Either side 139 of the shell 135 has a notch 140 therein in line with the path of travel of the containers 102. These notches 140 are provided with springs 141 or other resiliently flexible members which serve to block the entry into the shell 135 of any free floating product items but allow entry and exit of the items in containers 102, thereby ensuring that only the single item in the dispensing container 102 next in line to the apertures 84 and 88 is allowed to pass down the chute 36 upon operation of the machine.

As seen in FIGS. 6 and 6*a*, the springs 141 filling the notch 140 are preferably secured in place on buttons 142 by means of a retaining plate 143. This arrangement allows for easy maintenance of this aspect of the invention since broken springs 141 can be quickly and inexpensively replaced. The plate 143 is provided with small projections 144 insertable into dimples 145 in the top of the shell 135 so that the plate 143 can be accurately secured in place by a screw 146.

As mentioned, the shell 135 preferably has a notch 140 in each side 139 and each notch 140 may be similarly provided with resiliently flexible members 141. This arrangement allows items which are stuck in a container 102 to pass out of the shell 135 without damaging or jamming the machine.

As shown in FIG. 12, horizontally disposed springs 141 can be used in the notches 140 when the machine is being used to dispense large items. The horizontal springs 141 generaly provide a stiffer resistance to entry into the shell 135, which is desirable when the exclusion means is used for relatively large items.

Depending on the type of item being dispensed, it may be desirable to provide one or more means for effecting agitation of the product items as the machine is operated so that bridging of the items does not occur. Obviously, bridging of items in the bin 14 creates voids which may result in a dispensing failure upon operation of the machine. One type of agitating means which is formed integrally into the circular plate 98 is shown in FIG. 14. This plate 98 has curved ramps 150 extending from one container 102 to the next, and these ramps 150 provide the necessary amount of agitation for relatively small items so that bridging is avoided.

As shown in FIGS. 12 and 13, the machine may include a device 155 above the wheel 80 for agitating the contents of the product bin 14. The agitating device 155 comprises a conical shell 156 having apertures 157 into which are secured arms 158. The arms 158 are preferably flexibly resilient and may conveniently be springs. The arms are held in place in the apertures 157 by a second conical member 159 insertable within the conical shell 156. Both the shell 156 and the member 159 have a threaded opening 160 at the apices thereof into which is screwed a threaded tube 161 thereby fastening the shell 156 and member 159 together. The spindle 81 is provided with a rod 165 threaded into the center thereof and secured by a nut 166. The tube 161 and the rod 165 are of appropriate diameters so that the tube 161 may easily be inserted over the rod 165. Thus, when assembled, the rod 165 serves as an axle for the rotation of the agitating device 155.

As seen from FIG. 13, the lower circumference of the conical shell 156 engages the circular rim 168 of the circular opening 169 of a modified shell 135. The tube 161 extends to the top 13 of the machine, and thus, the agitating device 155 serves to prevent upward movement of the forward portion of the shell 135. The rear portion of the shell 135 is secured by screws through holes 138.

Rotation of the agitating device 155 is accomplished by means of a cylindrical flange 170 extending beneath the conical shell 156, which flange 170 has notches 171 which coact with corresponding projections 172 affixed to the hub 93 of the wheel 80. In operation, the flange 170 is supported by the hub 93 and the projections 172 in the notches 171 cause rotation of the device 155 upon rotation of the wheel 80 thereby effecting agitating of the bin 14 contents.

Additional agitating means may be provided on the spokes 92 of the wheel 80 as shown in FIG. 12 when dispensing large items. These means comprise fins 173 which may be attached to the spokes 92 by clips 174 formed integrally therewith. As with the ramps 150 in the circular plate 98 shown in FIG. 14 and described above, the fins 173 provide sufficient perturbations in the horizontal surface of the dispensing assembly to agitate the larger items dispensed using the configuration shown in FIG. 12 so that bridging is discouraged.

From FIG. 13 it can also be seen that the rod 165 has a threaded upper end which is insertable into an opening 175 in a hollow body 176 integral with and located centrally in the top 13. A threaded lock 177 is insertable into the body 176 and may be screwed onto the threads of the rod 165. Removal of a key 178 for the lock 177 so threaded onto the rod 165 secures the top 13 on the bin 14. This separate locking arrangement for the top 13 enables easy filling of the bin 14 and maintenance of the various components at the partition 17, without providing access to the cashbox 16.

Means are provided for attaching the base 12 of the machine to a rack 180 as shown in FIG. 10 or to a table or fixture 190 as shown in FIG. 11. As shown in FIG. 10, a bracket 181 comprising an upper plate 182 and a lower plate 183 is attachable by fasteners 184 to arms of a rack 180. The upper plate 182 has a threaded opening 185 therein which is registrable with an opening 186 in the central portion of the base 12. A threaded fastener 187 is screwed into the opening 185 in the plate 182 to secure the machine to the rack 180.

Greater security for the machine can be achieved by fastening it in place on a flat surface of a fixture as shown in FIG. 11. A bracket plate 191, which may be the same plate 182 shown in FIG. 10, but inverted, is secured by fasteners 192 to a flat surface 190, the bracket 191 having a threaded opening 193 therein which is registrable with an opening 186 in the base 12. A threaded fastener 187 is screwed into the opening 193 in the bracket 191 thereby securing the machine to the surface 190. Since the interior of the cashbox 16 is secured by virtue of the above mentioned features, theft of the machine affixed in this manner is discouraged.

I claim:

1. A coin operated vending machine comprising:

a housing having upright walls, a base, a top, and a partition between the base and top dividing the housing into an upper product bin and a lower cashbox, the partition defining an aperture therethrough to provide communication between the bin and cashbox and having a spindle protruding upwardly from the central portion thereof;

a dispensing wheel having:

a hub with bearing means at the center thereof for engaging the spindle and supporting the wheel upon rotation thereof about the spindle; a rim with a plurality of gear teeth about the circumference of the bottom edge thereof; and retaining members being provided between the hub and the rim defining a plurality of product openings in the wheel which are uniformly spaced from one another and the centre of the wheel and being registrable with the aperture in the partition upon rotation of the wheel, said wheel retaining members in combination with the surface of the partition forming containers for items of product to be dispensed;

a coin activated gear mechanism positioned in an upright wall of the housing in the vicinity of the partition, said mechanism having a handle attached to one end of a shaft and a transmission gear attached to the other end thereof, said gear engaging the teeth about the rim of the dispensing wheel so that rotation of the gear causes rotation of the wheel;

a product delivery chute positioned within the cashbox, one end of which abuts the partition about the periphery of the aperture therethrough and the other end of which protrudes through an opening in an upright wall of the housing;

a door for the delivery chute, said door activating a safety mechanism which locks the transmission gear upon opening the door;

means for locking the delivery chute in place thereby restricting access to the cashbox; and means positioned above the dispensing wheel at that portion of the partition defining the aperture therethrough for excluding all loose items of product from the aperture in the partition, thereby insuring that only items in containers are dispensed upon operation of the machine.

2. A machine as claimed in claim 1, further comprising a lower circular plate of a diameter less than that of the dispensing wheel positioned between the partition and the dispensing wheel, thereby providing the lower surface for the containers, the plate defining a central opening for fitting about the spindle, and having an aperture registrable with but of a smaller size than the aperture in the partition.

3. A machine as claimed in claim 2, wherein the plate has a flange at the underside thereof about the aperture which flange being insertable within the aperture of the partition thereby securing the plate in place.

4. A machine as claimed in claim 2, further comprising an upper circular plate attachable to the dispensing wheel and forming an upper surface therefor, the plate defining a plurality of product openings about each of which at the underside of the plate are affixed retaining members, the retaining members in combination with said lower circular plate forming the containers for items of product to be dispensed.

5. A machine as claimed in claim 4, further comprising guide means on the upper circular plate for guiding product items into the containers upon rotation of the wheel.

6. A machine as claimed in claim 5, wherein the guide means comprise ribs raised above the surface of the plate.

7. A machine as claimed in claim 5, wherein the upper plate and the dispensing wheel are recessed below the upper surface of the partition thereby forming a curb about the cirumference of the wheel, and said guide means coacting with said curb.

8. A machine as claimed in claim 1, wherein the coin activated gear mechanism and the product chute occupy a single opening in an upright wall of the housing.

9. A machine as claimed in claim 8, wherein the gear mechanism and chute are attached to a frame having peripheral flange means for fitting snuggly within said opening.

10. A machine as claimed in claim 1, further comprising a notch in the bottom of the chute into which is insertable said means for locking the chute in place.

11. A machine as claimed in claim 10, wherein the means for locking the delivery chute in place comprises an arm having an upstanding flange thereon, the arm being pivotable so as to cause the flange to engage or disengage the notch in the chute.

12. A machine as claimed in claim 11, wherein said arm is pivoted by means of a lever biased so as to cause said flange to be disegaged, the lever being pivoted about a fulcrum to cause engagement of the flange in said notch by lock secured means.

13. A machine as claimed in claim 12, wherein said lock secured means comprises a lock controlled cam.

14. A machine as claimed in claim 12, wherein said lock secured means comprises a lock controlled push rod.

15. A machine as claimed in claim 1, wherein the means for excluding loose items comprises a shell having a top from which depend sides extending to but spaced slightly above of the wheel so that rotation thereof is not impeded, the side toward which the containers move upon operation of the machine defining a notch to allow entry into the shell of an item seated in a container, said notch being provided with resiliently flexible members positioned therein which allow the item seated in a container to pass through the notch but which also serve to exclude all loose items from entry into the shell.

16. A machine as claimed in claim 15, wherein the resiliently flexible members are springs.

17. A machine as claimed in claim 16, wherein said springs are seated on buttons and retained in place by a plate covering the buttons.

18. A machine as claimed in claim 4, wherein the upper plate for the dispensing wheel is provided with curved ramps positioned in the spaces between the containers along the circular path of travel thereof, said ramps having a slope upwardly from the leading edge of passage through the notch upon rotation of the wheel, and said ramps providing means for agitating the contents of the product bin.

19. A machine as claimed in claim 15, wherein each side of the shell in the area about the travel path of the containers defines a notch each of which is provided with resiliently flexible members positioned therein.

20. A machine as claimed in claim 1, further comprising agitation means separate from and positioned above the dispensing wheel which means rotate upon rotation of the wheel to agitate the contents of the product bin.

21. A machine as claimed in claim 20, wherein the agitation means comprise a shell having apertures into which are secured arms, said shell being positioned over and being rotated by the hub of the wheel.

22. A machine as claimed in claim 21, wherein said arms are resiliently flexible.

23. A machine as claimed in claim 1, further comprising agitation means attachable to the retaining members of the dispensing wheel for agitating the contents of the product bin upon rotation of the wheel.

24. A machine as claimed in claim 23, wherein the retaining members are spokes of the wheel and the agitation means comprise fins formed integrally with clips attachable to said spokes so that the fins project above the top of the wheel.

25. A machine as claimed in claim 1, further comprising means in the base for securing the machine to a flat surface.

26. A machine as claimed in claim 25, wherein said securing means comprises a bracket plate having a threaded opening registrable with an opening in the base, said bracket being fastenable to a flat surface and the base being fastenable to the bracket plate by means of a threaded fastener.

27. A machine as claimed in claim 1, wherein the coin activated gear mechanism is located above the door of the delivery chute, said door being hinged at its top edge, a pivotable plate positioned above the door having teeth for engaging and locking the transmission gear, said mechanism including means for engaging and disengaging said teeth in the transmission gear upon opening and closing of the door.

28. A machine as claimed in claim 27, wherein said teeth engaging means comprises a spring biasing the plate into a gear engaging position, and an arm attached to and projecting from the plate which coacts with a cam affixed to the top edge of the door so that closure of the door forces the plate to disengage the gear.

29. A machine as claimed in claim 27, wherein the plate includes a web between the teeth thereby ensuring contact of the gear with the plate in the engagement mode.

* * * * *